United States Patent [19]

Benton

[11] Patent Number: 4,502,298

[45] Date of Patent: Mar. 5, 1985

[54] CHAMBERED BRACELET

[76] Inventor: Diana L. Benton, 1003 Franklin St., Watertown, N.Y. 13601

[21] Appl. No.: 532,463

[22] Filed: Sep. 15, 1983

[51] Int. Cl.[3] ..... A44C 5/00

[52] U.S. Cl. ..... 63/1 R; 224/219

[58] Field of Search ..... 63/1, 2, 3, 11, 8, 9; 224/197, 219, 222, 267

[56] References Cited

U.S. PATENT DOCUMENTS

| | | | |
|---|---|---|---|
| 2,255,999 | 9/1941 | Kuehner | 224/219 X |
| 2,796,747 | 6/1957 | Ebert | 63/1 R |
| 2,903,172 | 9/1959 | Carter | 224/219 |

FOREIGN PATENT DOCUMENTS

| | | | |
|---|---|---|---|
| 760792 | 12/1933 | France | 63/1 R |
| 819512 | 7/1937 | France | 63/1 R |
| 332208 | 10/1958 | Switzerland | 63/8 |

*Primary Examiner*—F. Barry Shay

*Attorney, Agent, or Firm*—Bruns and Wall

[57] ABSTRACT

A novel bracelet construction wherein the bracelet has one or more normally concealed chambers in which such things as folded paper money or pills or the like can be stored. Alternatively, the chambers can be utilized as personal cigarette ash receptacles if desired.

2 Claims, 9 Drawing Figures

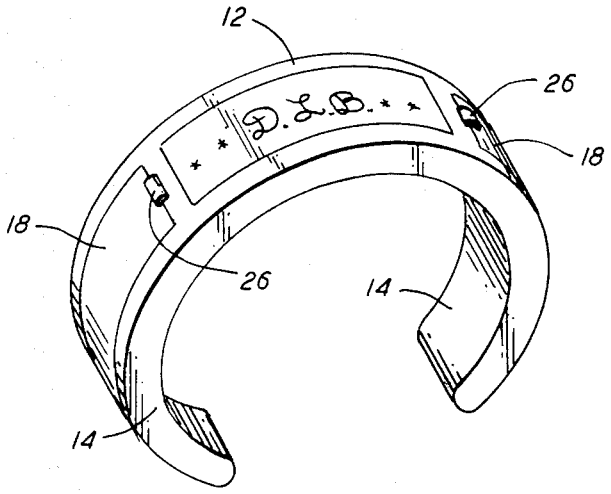
FIG. 1
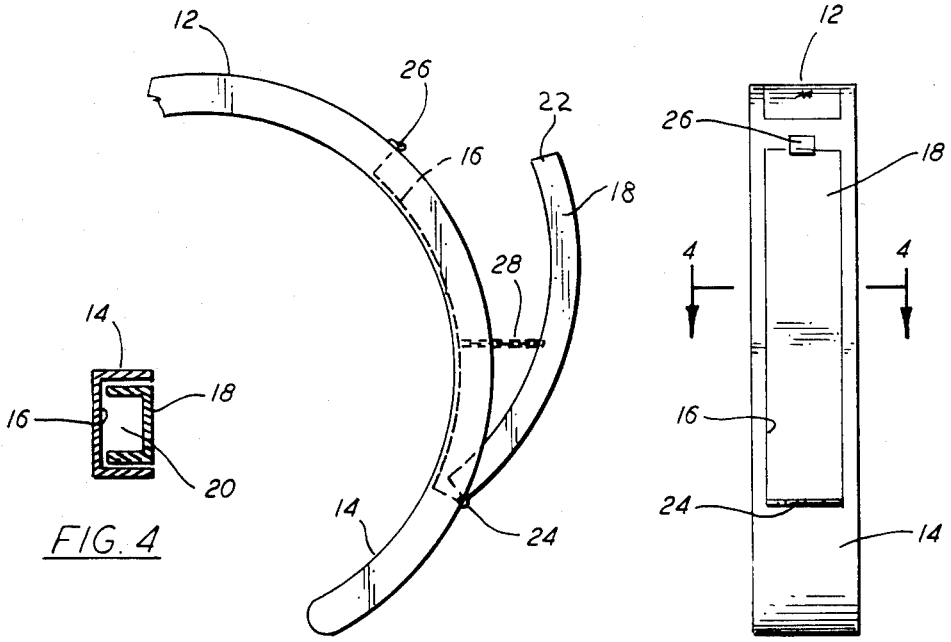
FIG. 4
FIG. 3
FIG. 2

CHAMBERED BRACELET

BACKGROUND OF THE INVENTION

This invention relates generally to articles of jewelry, and has particular reference to a novel bracelet construction wherein the bracelet has one or more normally concealed chambers therein.

Bracelets or wrist bands having receptacles for pills and cosmetics and keys have been developed heretofore. Examples of these are disclosed in U.S. Pat. Nos. 2,473,226 to Sheldon; 3,019,635 to Kling and 3,680,751 to TenBrook. The Sheldon patent discloses a wrist band having a receptacle for cosmetics or the like, Kling discloses a bracelet having an enclosure for a key and TenBrook discloses a curved pill container that is incorporated in a wrist band.

Other, less pertinent patents noted in the course of a preliminary search are U.S. Pat. Nos. 2,120,308 and 2,787,893.

SUMMARY OF THE INVENTION

The present invention is directed to a novel bracelet construction wherein the bracelet has one or more normally concealed chambers in which such things as folded paper money or pills or the like can be stored. Alternatively, the chambers can be utilized as personal cigarette ash receptacles if desired.

In one of its forms, the bracelet of the invention comprises an arcuate center portion and a pair of arculate leg portions on opposite sides of the center portion and formed integrally therewith. At least one of the leg portions is formed with an elongated recess in which an open topped receptacle is received with a close fit. The receptacle serves as the storage chamber and can be swung outwardly from the bracelet leg portion, without removing the bracelet from the wrist, to expose its access opening.

In another form, the bracelet comprises an arcuate center portion and a pair of arcuate leg portions that are discrete elements. The three discrete elements are secured together in contiguous, end to end relation by a strip spring member. Each leg portion is hollow and open at its end adjacent the center portion. The spring member is connected to the undersides of the three portions of the bracelet and with this arrangement pushing the free ends of the leg portions towards one another causes the open ends thereof to pivot away from the center portion whereby the open ends are exposed to enable articles to be inserted into or removed from the hollow leg portions.

BRIEF DESCRIPTION OF THE DRAWINGS

FIG. 1 is a perspective view of a bracelet embodying the invention;

FIG. 2 is a side elevation of the bracelet of FIG. 1;

FIG. 3 is a fragmentary front elevation of the bracelet showing its normally concealed receptacle in exposed position;

FIG. 4 is an enlarged transverse sectional view taken on line 4—4 of FIG. 2;

Figure 5:
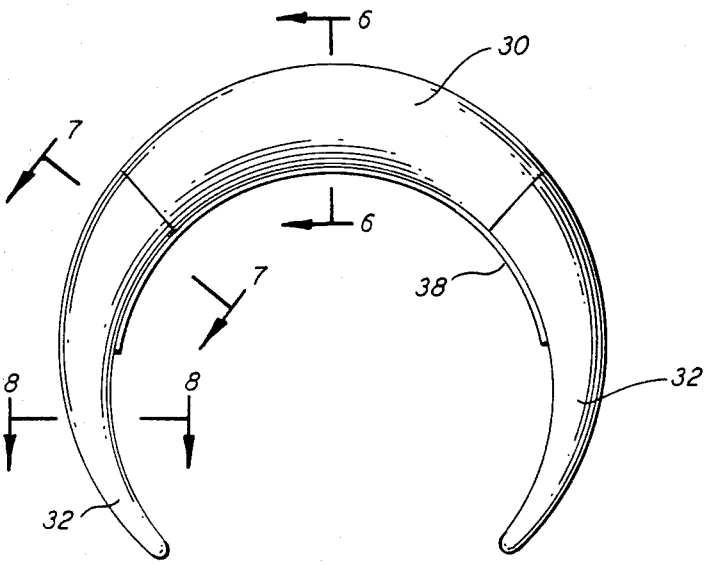
FIG. 5 is a front elevation of a modified form of the bracelet.

Having reference now to the drawings, and with particular reference to FIGS. 1—4, the bracelet is comprised of an arcuate center or medial portion 12 and a pair of opposed arcuate leg portions 14. In the illustrated embodiment, the bracelet is of the split ring type meaning that it does not encompass a full circle. The center portion 12 can be plain or provided with ornamentation as shown. The bracelet can be made of precious or non-precious metals, or of a suitable plastic.

The bracelet of FIG. 1 is generally rectangular in cross section, and in accord with the invention there is a normally concealed chamber in each leg portion 14. To this end, each leg portion is formed with an elongated recess 16, FIGS. 2 and 4, in which there is normally positioned a conforming, hollow receptacle 18 only one of which need be described as the two receptacles are identical. Receptacle 18 defines a chamber 20 that is open at its upper end 22.

The recess 16 and receptacle 18 are rectangular in cross section as best shown in FIG. 4 and the receptacle is received in the recess with a close sliding fit as indicated in FIGS. 1 and 2. The lower end of the receptacle is connected to its bracelet leg portion by a small, piano-type hinge 24, and the receptacle is normally held in the recess by small latch or clasp 26. When the clasp is released, the receptacle can be swung outwardly as shown in FIG. 3 to expose its open end 22, the outward movement of the receptacle being limited by a small chain 28 or the like. As will be apparent, gaining access to the receptacle does not require removing the bracelet from the wrist.

When the bracelet receptacles 18 are positioned in their respective recesses they are not noticeable except upon close examination. This is because the clasps 26 are small and can be made to look like ornamentation, and the hinges 24 are usually not visible because they are on the underside of the wrist when the bracelet is being worn. As noted above, the receptacles can be used for the storage of pills, folded paper money or other small articles. If the bracelet wearer is a cigarette smoker and no ash trays are available, one of the receptacles can be left in its open position and used for this purpose, see FIG. 3.

Figure 6:
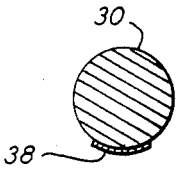
FIGS. 6, 7 and 8 are transverse sectional views taken respectively on lines 6—6, 7—7 and 8—8 of FIG. 5.
Figure 7:
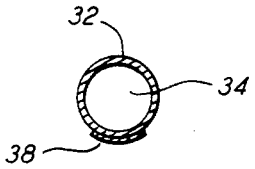
Figure 8:
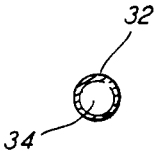
Figure 9:
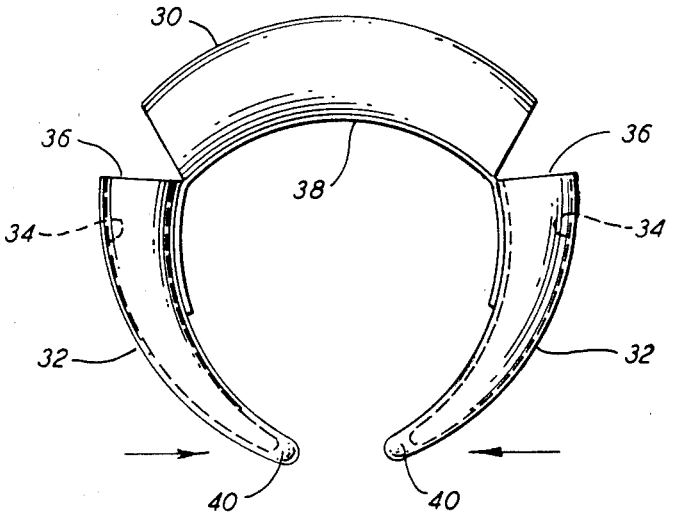
FIG. 9 is a front elevation corresponding to FIG. 5 but showing the free ends of the bracelet leg portions squeezed together to expose the chambers therein.

FIGS. 5-9 illustrate a modified form of the bracelet wherein the arcuate center portion 30 and opposed arcuate leg portions 32 are discrete elements. In accord with the invention the leg portions are hollow, each defining a chamber 34 that is open at its upper end 36. The center portion 30 is preferably solid as indicated in FIG. 6. The center and leg portions are connected together in end to end relation, FIG. 5, by a thin elongated strip 38 of spring material that is soldered, welded or otherwise secured to the undersides of the portions.

The spring strip 38 urges the leg portions 32 of the bracelet into close contact with the center portion whereby the storage chambers 34 are concealed. However, if the free ends 40 of the leg portions are squeezed together, see FIG. 9, against the action of the spring strip, the upper ends 36 of the leg portions pivot away from the center portion whereby the chambers are exposed for the insertion or removal of articles. As will be apparent, eigher leg portion can be pivoted to expose its storage chamber without pivoting the other leg portion.

From the foregoing description it will be apparent that the invention provides novel bracelet constructions having normally concealed storage chambers therein. As will be understood by those familiar with the art, the invention may be embodied in other specific forms without departing from the spirit or essential characteristics thereof.

I claim:

1. A chambered bracelet of the split ring type comprising an arcuate medial portion and a pair of opposed arcuate leg portions positioned on opposite sides of the medial portion, the medial and leg portions being discrete elements, and a strip spring member connecting the three portions in contiguous, end to end relation, each leg portion being hollow and open at its end adjacent the medial portion, the spring member permitting the leg portions to be pivoted away from the medial portion to expose their open ends.

2. A bracelet as defined in claim 1 wherein the spring member is a thin elongated plate secured to the undersides of the medial and leg portions whereby pushing the free ends of the leg portions towards on another operates to pivot them relative to the medial portion.

* * * * *

UNITED STATES PATENT AND TRADEMARK OFFICE

CERTIFICATE OF CORRECTION

PATENT NO. : 4,502,298

DATED : March 5, 1985

INVENTOR(S) : Diana L. Benton

It is certified that error appears in the above—identified patent and that said Letters Patent is hereby corrected as shown below:

Column 4, line 9, "one" should read -- on --.

Signed and Sealed this

*Sixth* Day of *August 1985*

[SEAL]

*Attest:*

DONALD J. QUIGG

*Attesting Officer* *Acting Commissioner of Patents and Trademarks*